US005807083A

United States Patent [19]

Tomoiu

[11] Patent Number: 5,807,083

[45] Date of Patent: Sep. 15, 1998

[54] HIGH PRESSURE GAS COMPRESSOR

[76] Inventor: Constantin Tomoiu, 981 Hancock Ave., Bridgeport, Conn. 06605

[21] Appl. No.: 624,785

[22] Filed: Mar. 27, 1996

[51] Int. Cl.[6] ..... F04B 1/12

[52] U.S. Cl. ..... 417/398; 417/392

[58] Field of Search ..... 417/245, 398, 417/383, 225, 392, 399, 266; 60/407, 419, 39.01

[56] References Cited

U.S. PATENT DOCUMENTS

| | | | |
|---|---|---|---|
| 3,945,207 | 3/1976 | Hyatt | 417/225 X |
| 4,097,198 | 6/1978 | Herron | 417/245 |
| 4,229,143 | 10/1980 | Pucher et al. | 417/383 X |
| 4,360,325 | 11/1982 | Galloway | 417/399 |
| 4,705,460 | 11/1987 | Braun | 417/266 |
| 5,092,743 | 3/1992 | Dietrich | 417/392 |

*Primary Examiner*—Ismael Izaguirre
*Attorney, Agent, or Firm*—Fattibene and Fattibene; Paul A. Fattibene; Arthur T. Fattibene

[57] ABSTRACT

A low pressure compressor drives a hydraulic pump coupled to a main compressor for producing a relatively high pressure gas output. A plurality of pistons coupled to a single shaft is driven by gas from a low pressure compressor. A hydraulic piston is coupled to one end of the shaft and forces hydraulic fluid from a hydraulic cylinder into a main compressor having a main hydraulic cylinder and a free main piston. The free main piston is forced to one end of a main air or gas cylinder. Passages from the main air or gas cylinder direct the high pressure air or gas to a gas or air storage tank. The high pressure gas contained within the storage tank is then released when needed. A series of valves control the direction and pressure of the gas or air and hydraulic fluid. The present invention makes possible the production of relatively high gas pressures. Additionally, the present invention remains relatively cool during operation.

16 Claims, 4 Drawing Sheets

HIGH PRESSURE GAS COMPRESSOR

FIELD OF THE INVENTION

The present invention relates in general to gas or air compressors, and more particularly to a gas compressor using hydraulics to obtain a high gas pressure.

BACKGROUND OF THE INVENTION

There are many applications where gas at a high pressure, greater than several hundred pounds per square inch, is necessary or desired. One such application is in the use of combustion engines. For example, most combustion engines will be more efficient if use with a high pressure. One such combustion engine is disclosed in U.S. Pat. No. 5,426,940 entitled "Free Piston External Combustion Engine" issuing to Tomoiu on Jun. 27, 1995, which is herein incorporated by reference. This combustion engine will be more efficient when used with a compressor providing high gas or air pressure to the combustion chamber. However, most gas or air compressors only produce several hundred pounds of gas or air pressure. Additionally, they are generally inefficient and produce high temperatures during operation. Accordingly, there is a need for a simple and efficient gas or air compressor that can produce greater than several hundred pounds per square inch of pressure and up to several thousand pounds per square inch of gas or air pressure.

SUMMARY OF THE INVENTION

The present invention is a gas compressor that uses low pressure gas to drive a hydraulic piston for producing a higher pressure gas. Low pressure air is fed into a plurality of air cylinders connected to a shaft. This shaft is driven by the plurality of low pressure gas pistons, which pumps hydraulic fluid into a main hydraulic cylinder. A main piston in the main hydraulic cylinder advances into a main air or gas cylinder creating high pressure gas or air. After a predetermined pressure is obtained, a valve releases the high gas pressure into a gas or air storage tank. After release of the high gas pressure the hydraulic fluid is quickly released into a oil tank creating a cooling effect. In one embodiment, the main piston has a smaller diameter hydraulic piston and a larger diameter air or gas piston.

Accordingly, it is an object of the present invention to develop high pressure compressed gas or air.

It is an advantage of the present invention that it is self cooling.

It is a feature of the present invention that a hydraulic pump is used.

These and other objects, advantages, and features will become readily apparent in view of the following detailed description.

DETAILED DESCRIPTION OF THE PREFERRED EMBODIMENTS

Figure 1:
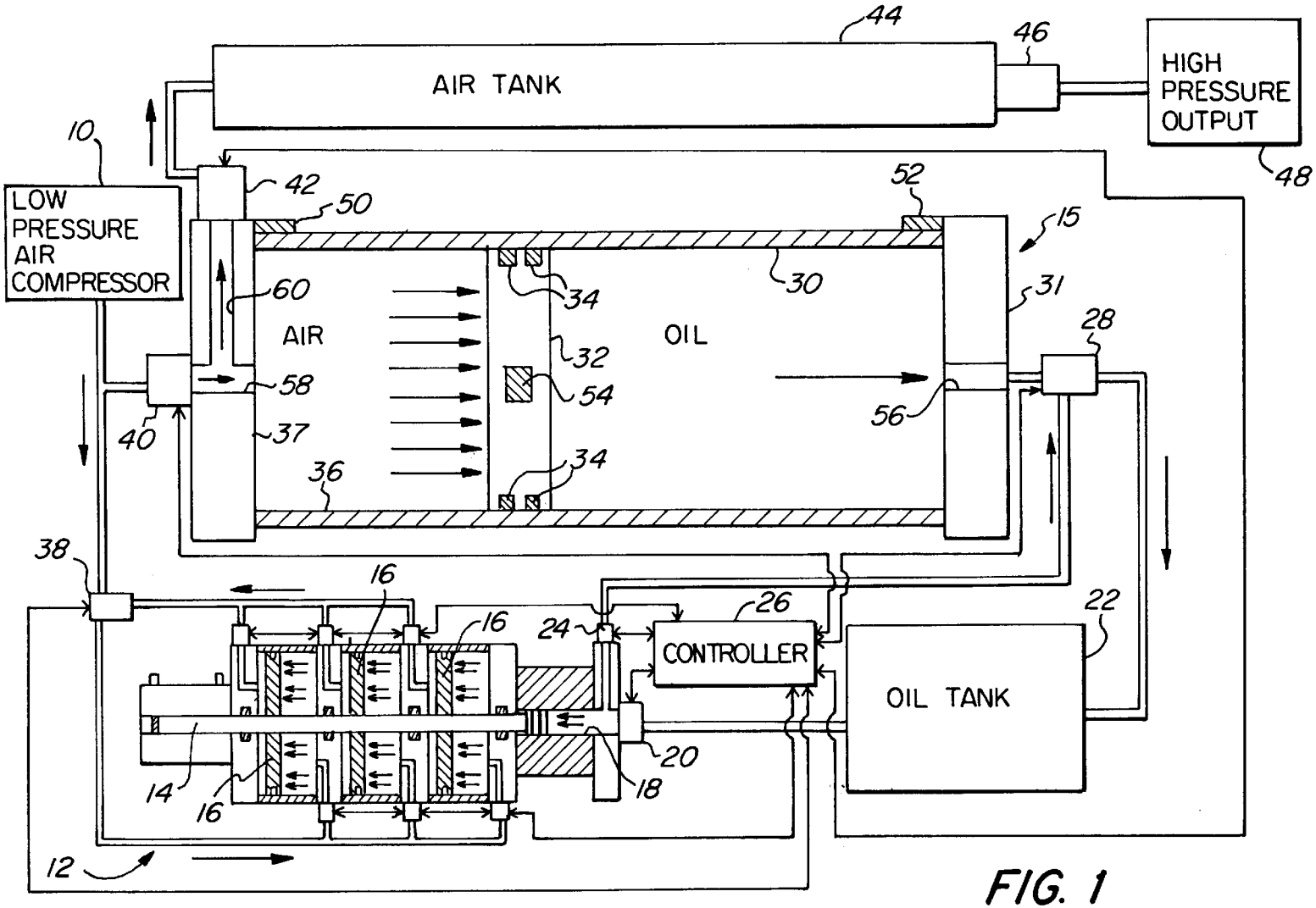
FIG. 1 is a schematic diagram illustrating the present invention.

FIG. 1 schematically illustrates the present invention. A low pressure air or gas compressor 10 provides low pressure air or gas to a hydraulic pump 12 through valve 38. The hydraulic pump 12 is powered by the low pressure compressor 10. A shaft 14 is connected to a plurality of pistons 16. One end of the shaft 14 is placed within a hydraulic cylinder 18. The hydraulic cylinder 18 is supplied hydraulic fluid or oil from oil tank 22 through inlet valve 20. The hydraulic cylinder 18 is also coupled to an outlet valve 24. Valves associated with each of the plurality of pistons 16 and the outlet valve 24 are controlled by controller 26. The hydraulic fluid or oil released from outlet valve 24 is directed to a main piston valve 28. Main piston valve 28 directs the hydraulic fluid or oil into a main compressor 15. The valves may be electrically operated. The main compressor 15 includes a main hydraulic cylinder 30. Hydraulic fluid or oil enters the main hydraulic cylinder 30 through opening 56 in the hydraulic cylinder end wall 31. A free main piston 32 seals the hydraulic cylinder 30 at the end opposite the hydraulic cylinder end wall 31. The free main piston 32 is free to move back and forth within the main hydraulic cylinder 30. Seals 34 prevent the hydraulic oil or fluid from passing the free main piston 32. On the other side of the free main piston 32 is main air cylinder 36. At the end opposite the free main piston 32 of the main gas cylinder 36 is a gas cylinder end wall 37. Gas opening 58 is formed within the gas cylinder end wall 37. The gas opening 58 communicates through valve 40 to the low pressure compressor 10. A passage 60 formed within the gas cylinder end wall 37 couples the gas opening 58 to a high pressure gas valve 42. Valve 42 may be a check valve that opens automatically when a predetermined pressure is obtained. The high pressure gas valve 42 in turn is coupled to a gas or air storage tank 44. On one end of the gas or air tank 44 is a valve 46 which effects the controlled release of high pressure compressed air or gas. Accordingly, high pressure output 48 is obtained. Associated with the free main piston 32 are sensors 50, 52, and 54. The sensors 50, 52, and 54 may be any sensors, for example sensors 50 and 52 may be magnet proximity sensors, and sensor 54 may be a magnet. Therefore, the sensors 50 and 52 are used to detect the magnet. As a result this detects the position of the free main piston 32 within the main hydraulic and gas cylinders 30 and 36. Alternatively, the sensors 50 and 52 may be replaced by a pressure switch which detects the pressure within either of the cylinders 30 and 36, thereby selectively controlling the opening of main piston valve 28. The sensors 50 and 52 or pressure switches may also be used to control other valves and operations within the compressor. For example the sensor 50, or a pressure switch may be used to start the hydraulic pump 12 when main gas cylinder 36 has been charged with relatively low pressure air or gas from low pressure air or gas compressor 10. Also, the sensor 52 or a pressure switch may be used to stop the hydraulic pump 12 when a pressure higher than the desired pressure is obtained, indicating that the free main piston 32 has reached the end of its travel at gas cylinder end wall 37.

Figure 2:
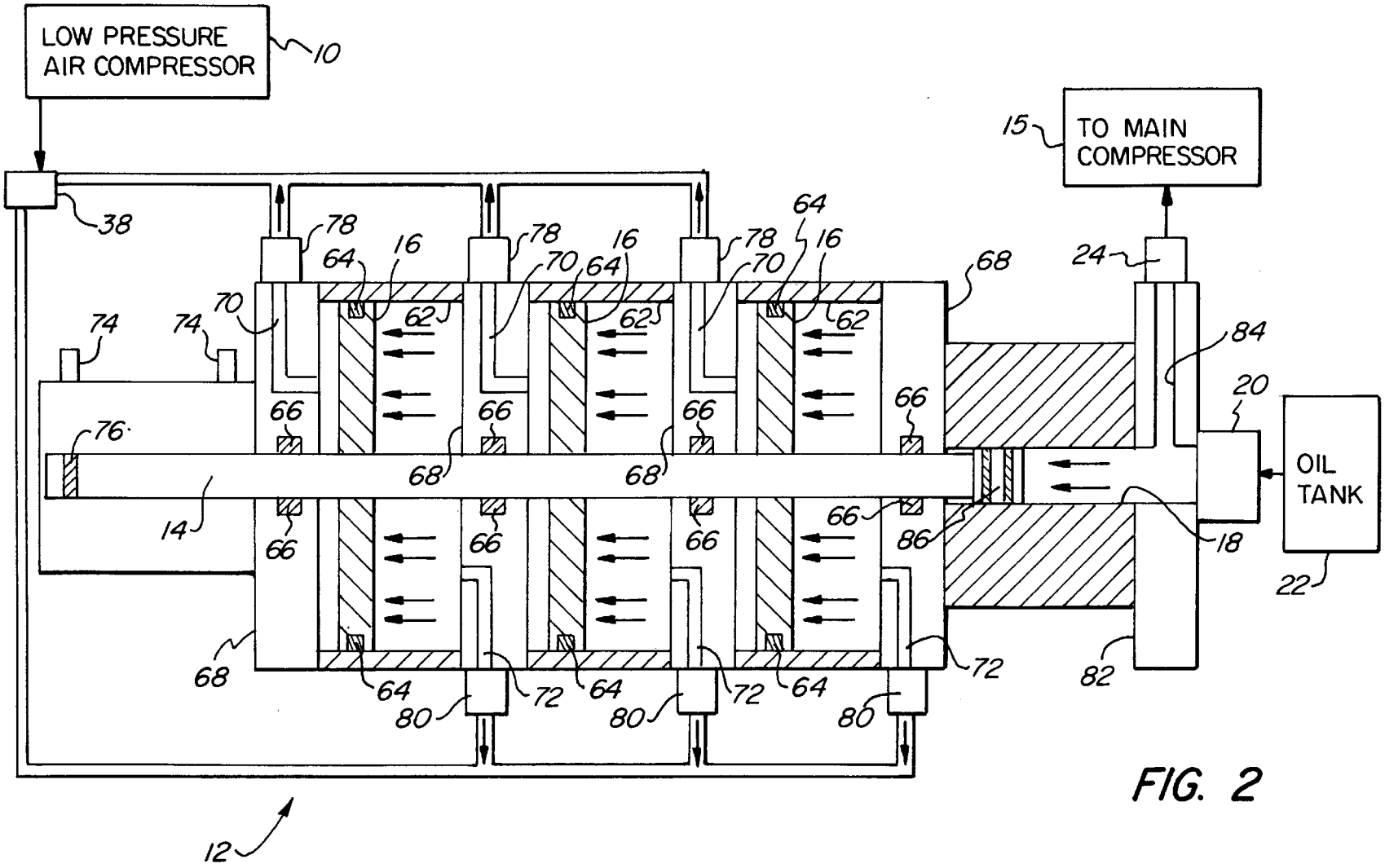
FIG. 2 is a schematic diagram of an enlarged view of the hydraulic pump illustrated in FIG. 1.

FIG. 2 schematically illustrates more clearly the gas driven hydraulic pump 12 illustrated in FIG. 1. Shaft 14 is connected to a plurality of pistons 16 that are placed within a plurality of cylinders 62. Piston seals 64 seal the mating surfaces between the plurality of cylinders 62 and the plurality of pistons 16. A plurality of walls 68 form chambers in which the plurality of pistons 16 are placed. Within each of the walls 68 are shaft seals 66 which effectively prevent leakage between the walls 68 and the shaft 14. Formed within the walls 68 is a plurality of low gas pressure passages 70. One of the plurality of low gas pressure passages 70 is open to one side of the plurality of pistons 16.

The low gas pressure passages 70 are coupled through valves 78 to valve 38 and then to the low pressure air compressor 10. A plurality of low gas pressure passages 72 are formed in walls 68 and coupled to the other side of the plurality of pistons 16. The low air pressure passages 72 are coupled through valves 80 to valve 38 and then to the low pressure compressor 10. One end of the shaft 14 is placed within the hydraulic cylinder 18 and has a hydraulic piston 86 thereon. The other end of the shaft has a magnet core 76 placed thereon. The magnet core 76 cooperates or is associated with proximity switches 74. Accordingly, the longitudinal position of the shaft 14 is determined. Adjacent hydraulic cylinder 18 is end wall 82. Valve 20 is positioned at the end of hydraulic cylinder 18 opposite the hydraulic piston 86 and controls the placement of hydraulic fluid or oil from oil tank 22 into the hydraulic cylinder 18. Communicating with the hydraulic cylinder 18 is a high pressure hydraulic fluid or oil passage 84. Release of the high pressure hydraulic fluid within passage 84 is controlled by valve 24 which is in communication with the main compressor 15.

The operation of the present invention can now readily be appreciated with reference to FIGS. 1 and 2. Low pressure compressor 10 provides low pressure compressed gas or air to valve 38. The low pressure gas may be obtained from the exhaust of a combustion engine. Valve 38 directs the low pressure gas or air to either valves 78 or 80. Valves 78 are used to drive the pistons 16 connected to the shaft 14, and thereby the hydraulic piston 86 within the hydraulic cylinder 18. When valves 78 are opened, low pressure air or gas passes through passages 70 forcing the plurality of pistons 16 to advance. The combined air or gas pressure on the plurality of pistons 16 is applied to the relatively small surface area of the hydraulic piston 86. This force is applied to the hydraulic fluid or oil contained within the hydraulic cylinder 18. To develop the hydraulic pressure within cylinder 18, valve 20 would be closed causing the hydraulic fluid to move up passage 84 and through open valve 24 to valve 28 where it is directed into the opening 56 and into the main hydraulic cylinder 30. The hydraulic fluid or oil entering the hydraulic cylinder 30 forces free main piston 32 to compress gas or air within the main gas cylinder 36. Once a predetermined pressure is obtained within the main gas cylinder 36, the air or gas is caused to enter opening 58 and advance up high pressure gas opening or passage 60. Valve 40 would be closed during this high pressure operation. Valve 42 would be open, letting the high pressure gas or air into the gas or air tank 44 where it is stored. When needed, the high pressure air is released by valve 46 forming high pressure output 48. Once the main piston 32 advances to the air cylinder end wall 37, valve 42 is closed along with valve 38 or valve 24 and valve 28 is opened to release the oil or hydraulic fluid within the main hydraulic cylinder 30 into the oil or hydraulic fluid tank 22. The oil or hydraulic fluid, under a relatively high pressure, expands quickly when released by valve 28 causing a vacuum near the surface of the main free piston 32. This quick release of the slightly compressed hydraulic fluid or oil causes a temperature drop helping to cool the air or gas compressor. Additionally, the free main piston 32 is drawn toward the hydraulic cylinder end wall 31. This is caused by a vacuum created behind the free main piston 32 due to the rapid release of the hydraulic fluid pressure. However, if additional force is needed to move the free main piston 32 toward the hydraulic cylinder end wall 31, valve 40 may be opened to permit the low pressure compressor 10 to assist in advancing the free main piston 32 toward the hydraulic cylinder end wall 31. The cycle is thereafter repeated continuously until the desired high air or gas pressure is obtained within the air or gas storage tank 44. The controller 26 may be used to control both valves 78 and 80, as well as 24, in addition to the other valves used throughout the system in combination with any sensors or detectors that may be used to determine the position or location of the various elements of the present invention. Accordingly, the whole device and process may be easily automated with controllers and sensors that are well known.

Figure 3:
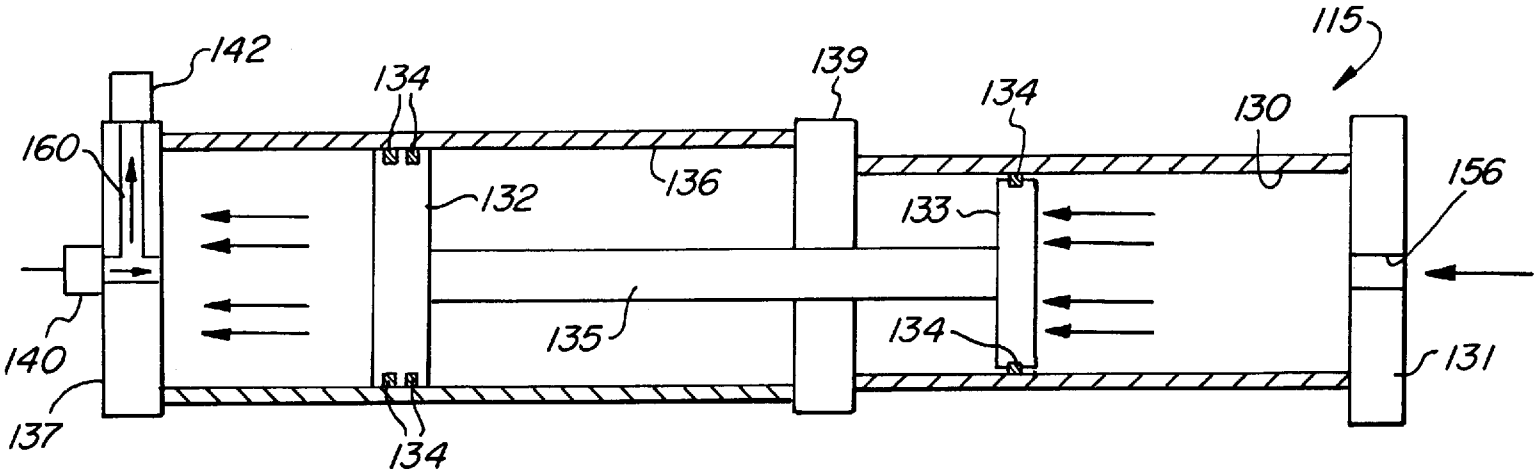
FIG. 3 is a schematic diagram illustrating another embodiment of the main cylinder and piston of the present invention.

FIG. 3 schematically illustrates an embodiment of a main compressor 115 that may be used instead of the main compressor 15 illustrated in FIG. 1. In this embodiment of the main compressor, the hydraulic cylinder 130 has a smaller diameter than the gas or air cylinder 136. Accordingly, a larger volume of gas or air may be compressed per volume of hydraulic fluid or oil. Hydraulic fluid or oil enters hydraulic cylinder 130 through opening 156 in the hydraulic end wall 131. Hydraulic piston 133 is coupled to the air piston 132 by a rod 135. Rod 135 extends through connecting wall 139. The pistons 132 and 133 are sealed to their respective cylinders 130 and 136 by seals 134. High pressure air passage 160 is formed within air cylinder end wall 137. The release of the compressed gas is controlled by valve 142. Valve 142 communicates with the low pressure compressor 10, illustrated in FIGS. 1 and 2. The operation of the embodiment illustrated in FIG. 3 is analogous to the operation as described for the present invention, illustrated in FIGS. 1 and 2.

Figure 4:
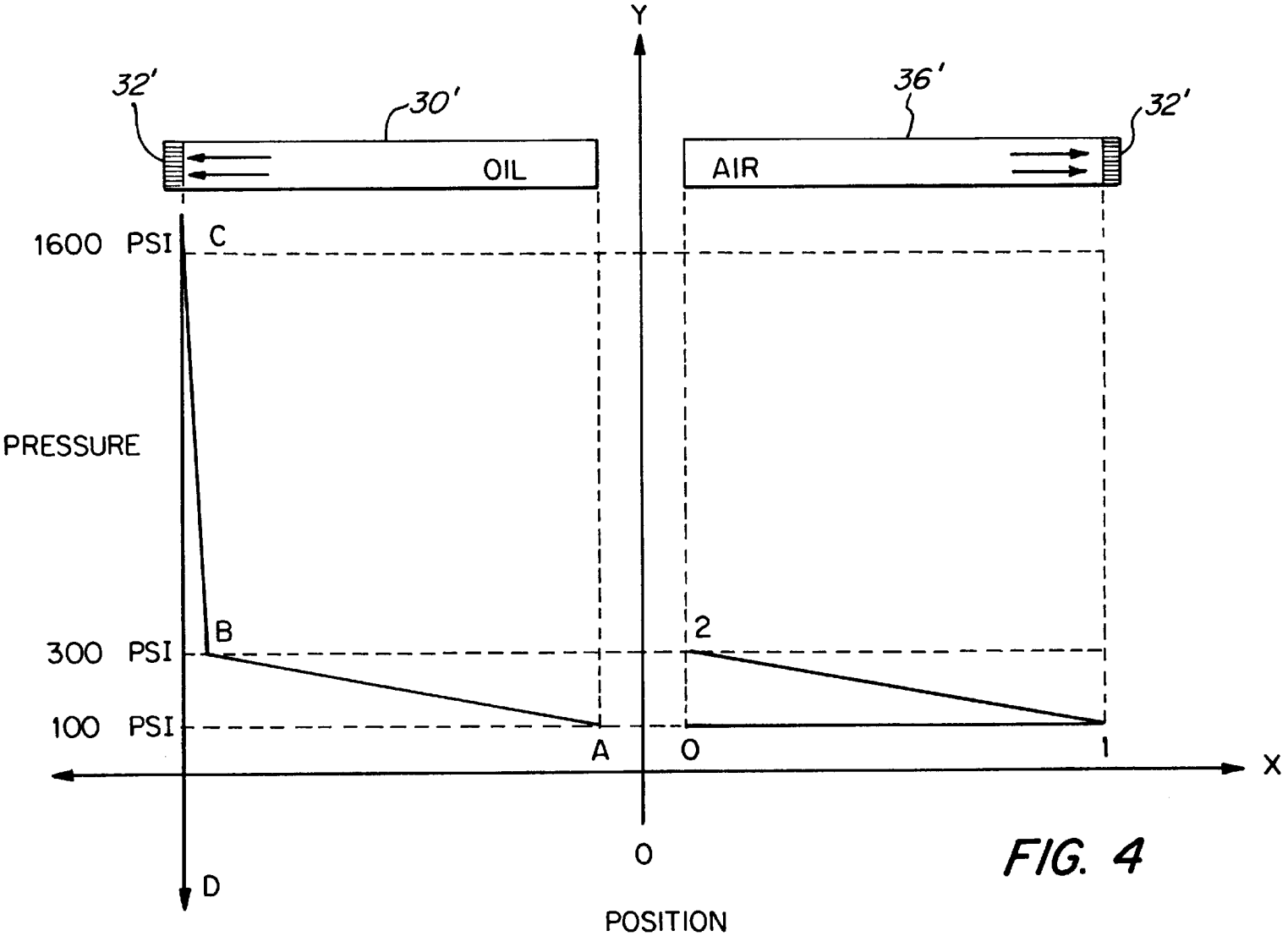
FIG. 4 graphically illustrates the cycle of the present invention.

FIG. 4 illustrates graphically the cycle of the present invention. The X axis represents position and the Y axis represents pressure. At point 0 on the graph, the free piston 32' in the main gas cylinder 36' is forced by the low pressure compressor toward one end to point 1 on the graph at a constant pressure, for example, 100 psi. As the free piston 32' is forced to the other end of the main gas cylinder 36', pressure within the main gas cylinder 36' increases to point 2 on the graph, for example, 300 psi. This is the desired or predetermined pressure selected for the high pressure output 48, illustrated in FIG. 1. This cycle is thus repeated. It should be appreciated that 300 psi is only an example of the predetermined or desired pressure, and that much higher pressures, up to several thousand pounds per square inch are obtainable with the present invention. The other side of the graph, the left side, illustrates the cycle for the main hydraulic cylinder 30' and main free piston 32'. Beginning at point A on the graph, the free main piston 32' advances towards one end causing the pressure to increase to point B on the graph, 300 psi. At point B, a mechanical stop is reached, such at the end of the main hydraulic cylinder 30', causing the oil pressure to increase quickly and dramatically to a very high pressure such as for example 1600 psi. Upon release of the pressure, the hydraulic oil drops in pressure very quickly, causing a temperature drop as well as a vacuum, drawing the free main piston 32' towards the open end. This temperature drop helps to cool the device causing it to remain at substantially room temperature. Also, because the present invention is able to run at an unexpectedly low temperature without the need for auxiliary cooling, the present invention is able to concentrate more mass of air or gas in the storage tank than other compressors. For example a prototype of the present invention has obtain an output pressure of approximately 1600 pounds per square inch while maintaining a substantially constant temperature of approximately 72 degrees Fahrenheit.

From the above it should readily be appreciated that the present invention advances the art in providing a high gas pressure output that heretofore has been difficult to achieve. This is accomplished easily and efficiently with an apparatus that is self-cooling.

While the preferred embodiment has been illustrated and described, it will be obvious to those skilled in the art that various modifications may be made without departing from the spirit and scope of this invention.

What is claimed is:

1. A gas compressor comprising:

a chamber;

a free piston placed within said chamber, said free piston having a gas side and a hydraulic side;

a gas pressure outlet placed within said chamber on the gas side of said free piston;

a hydraulic inlet placed within said chamber on the hydraulic side of said free piston;

a hydraulic pump connected to said hydraulic inlet; and a gas source connected to said hydraulic pump, whereby said gas source drives said hydraulic pump which pumps fluid into said chamber causing said free piston to move generating a relatively high gas pressure at said gas pressure outlet.

2. A gas compressor as in claim 1 wherein:

said hydraulic pump includes a plurality of pistons powered by said gas source.

3. A gas compressor as in claim 2 further comprising:

a shaft connected to the plurality of pistons; and a hydraulic piston connected to said shaft.

4. A gas compressor as in claim 3 wherein:

the plurality of pistons have a first combined surface area for contact with gas from said gas source; and said hydraulic piston has a second surface area for contact with hydraulic fluid, the first combined surface area being greater than the second surface area.

5. A gas compressor as in claim 3 further comprising:

a low pressure compressor valve coupled to said gas source, said low pressure compressor valve selectively directing gas to a first and second side of the plurality of pistons, whereby said plurality of pistons are caused to move back and forth causing said hydraulic piston to move back and forth.

6. A gas compressor as in claim 5 further comprising:

a main piston valve coupled to said chamber on the hydraulic side of said free piston and said hydraulic pump;

a high pressure valve coupled to said chamber on the gas side of said free piston and a high pressure output; and a controller coupled to said low pressure compressor valve, main piston valve, and high pressure valve.

7. A gas compressor as in claim 6 further comprising:

a storage tank placed between said high pressure valve and the high pressure output.

8. A gas compressor as in claim 7 further comprising:

a hydraulic oil tank coupled to said main piston valve and said hydraulic pump.

9. A gas compressor as in claim 1 wherein:

the gas is air.

10. A gas compressor comprising:

a cylindrical chamber, said cylindrical chamber including a main gas cylinder and a main hydraulic cylinder;

a free piston placed within said cylindrical chamber, said free piston dividing the main gas cylinder and the main hydraulic cylinder and having a gas side and a hydraulic side;

a main gas cylinder end wall closing the main gas cylinder of said cylindrical chamber, said gas cylinder end wall having a low pressure opening therein and a high pressure opening therein;

a main hydraulic cylinder end wall closing the main hydraulic cylinder of said cylindrical chamber, said main hydraulic cylinder end wall having an oil opening therein;

a plurality of cylinders;

a plurality of pistons, one of said plurality of pistons placed within each of said plurality of cylinders, each of said plurality of pistons having a drive side and a return side;

a shaft connected to said plurality of pistons;

a hydraulic piston connected to one end of said shaft;

a hydraulic cylinder associated with said hydraulic piston;

a relatively low pressure gas source selectively connected to the drive side and the return side of said plurality of pistons, whereby the plurality of pistons are driven moving said shaft;

an oil tank selectively coupled between said hydraulic cylinder and the oil opening in said main hydraulic cylinder end wall;

a high pressure gas valve connected to the high pressure opening, said high pressure gas valve opening after a predetermined pressure is obtained; and a gas storage tank connected to said high pressure gas valve, whereby said relatively low pressure gas source drives said plurality of pistons connected to said shaft and hydraulic piston which pumps hydraulic fluid into the main hydraulic cylinder causing said free piston to move generating a relatively high gas pressure at the high pressure opening.

11. A method of operating a compressor comprising the steps of:

compressing a gas to a predetermined pressure with hydraulic fluid;

compressing the hydraulic fluid to a pressure higher than the predetermined pressure; and releasing the hydraulic fluid, whereby the release of the hydraulic fluid causes cooling.

12. A hydraulic pump comprising:

a plurality of gas chambers;

a plurality of gas pistons, one of said plurality of gas pistons placed within each of said plurality of gas chambers;

a shaft connected to each of said plurality of gas pistons;

a hydraulic piston connected to one end of said shaft;

a hydraulic chamber, said hydraulic piston extending within one end of said hydraulic chamber, said plurality of gas chambers, plurality of gas pistons, shaft, hydraulic piston, and hydraulic chamber all having a common axis; and a gas source, said gas source coupled to each of said plurality of gas chambers, whereby said gas source drives said plurality of pistons causing said hydraulic piston to advance within said hydraulic chamber.

13. A hydraulic pump comprising:

a plurality of gas chambers:

a plurality of gas pistons, one of said plurality of gas pistons placed within each of said plurality of gas chambers;

a shaft connected to each of said plurality of gas pistons;

a hydraulic piston connected to one end of said shaft;

a hydraulic chamber, said hydraulic piston extending within one end of said hydraulic chamber; and a gas source, said gas source coupled to each of said plurality of gas chambers, each of said plurality of pistons has a drive side and a return side; and said gas source is selectively coupled to the drive side and the return side, whereby said gas source drives said plurality of pistons causing said hydraulic piston to advance within said hydraulic chamber.

14. A hydraulic pump as in claim 13 further comprising:

an oil tank coupled to said hydraulic chamber.

15. A hydraulic pump as in claim 14 further comprising:

a plurality of drive valves, one of said plurality of drive valves associated with each of said plurality of gas chambers and said gas source; and a plurality of return valves, one of said plurality of return valves associated with each of said plurality of gas chambers and said gas source, whereby each of said plurality of drive and return valves are selectively opened and closed controlling the number of piston used to drive said shaft.

16. A hydraulic pump as in claim 13 wherein:

said gas source is an air source.

* * * * *